US006193439B1

(12) United States Patent
Wolfseher

(10) Patent No.: US 6,193,439 B1
(45) Date of Patent: Feb. 27, 2001

(54) PROCESS FOR CLADDING SUBSTRATES AND CONSTRUCTIONS PRODUCED THEREBY

(75) Inventor: Roland F. Wolfseher, Zurich (CH)

(73) Assignee: MBT Holding AG, Zurich (CH)

( * ) Notice: Subject to any disclaimer, the term of this patent is extended or adjusted under 35 U.S.C. 154(b) by 0 days.

(21) Appl. No.: 09/101,212

(22) PCT Filed: Dec. 18, 1996

(86) PCT No.: PCT/CH96/00446

§ 371 Date: Feb. 22, 1999

§ 102(e) Date: Feb. 22, 1999

(87) PCT Pub. No.: WO97/25484

PCT Pub. Date: Jul. 17, 1997

(30) Foreign Application Priority Data

Jan. 8, 1996 (EP) ..... 96100148

(51) Int. Cl.[7] ..... E21D 11/10

(52) U.S. Cl. ..... 405/150.2; 405/150.1; 405/146

(58) Field of Search ..... 405/150.2, 146, 405/150.1, 151

(56) References Cited

U.S. PATENT DOCUMENTS

| | | | | |
|---|---|---|---|---|
| 3,381,479 | * | 5/1968 | Curzio | 405/150.2 |
| 3,545,213 | * | 12/1970 | Sebor et al. | 405/150.2 |
| 3,698,066 | * | 10/1972 | Cornwell | 405/150.2 X |
| 3,858,400 | * | 1/1975 | Bernold | 405/150.2 |
| 4,129,991 | * | 12/1978 | Schaden | 405/150.2 X |
| 4,695,188 | * | 9/1987 | Pulkkinen | 405/150.2 |

FOREIGN PATENT DOCUMENTS

| | | |
|---|---|---|
| 560 811 | 4/1975 | (CH) . |
| 591 010 | 8/1977 | (CH) . |
| 32 24 859 A1 | 1/1984 | (DE) . |
| 42 00 007 A1 | 7/1993 | (DE) . |
| 0 143 918 | 6/1985 | (EP) . |
| 2 283 306 | 3/1976 | (FR) . |
| 2 560 650 | 9/1985 | (FR) . |
| 85/04214 | 9/1985 | (WO) . |
| 87/04756 | 8/1987 | (WO) . |

* cited by examiner

*Primary Examiner*—David Bagnell
*Assistant Examiner*—Sunil Singh
(74) *Attorney, Agent, or Firm*—Fish & Richardson P.C.

(57) ABSTRACT

A construction for a partially-anchoring substrate, particularly a tunnel, comprises a sealing front layer applied to the substrate or an initial concrete layer applied thereto, and a non-deformable second layer applied to the first layer, the surface of the first layer (and, if present, the initial concrete layer) being profiled so that the various layers are locked together and behave as a single layer. The result is better performance with essential less material and work.

16 Claims, 3 Drawing Sheets

PROCESS FOR CLADDING SUBSTRATES AND CONSTRUCTIONS PRODUCED THEREBY

This invention relates to a process for cladding partially-overhanging substrates, and to constructions produced thereby.

By "partially-overhanging substrates" is simply meant substrates which partially overhang. The most obvious type is a tunnel which has an overhanging roof and non-overhanging walls, as well as other excavations. Alternatively, the "partially-overhanging substrate" can also be a building or concrete construction, such as an arch.

When a tunnel is driven underground, it is generally required that the rock surface left exposed be clad, for either or both of waterproofness or structural integrity. The traditional way of doing this has been to apply a sealing layer to the rock face, followed by a supporting layer. First of all, the rock surface of the tunnel is coated with an initial concrete layer by any convenient method, such as by shotcreting or spraying, or by applying prefabricated sections which are grouted. To this is applied the sealing layer, typically a waterproofing membrane consisting of welded, prefabricated sheets of a flexible plastic material, typically a synthetic polymer materials such as polyvinyl chloride (PVC) or polyethylene. This sheeting is held in place by suitable anchoring means. Finally, there is applied a supporting layer, generally by means of formwork or prefabricated sections. Steel reinforcement is usually included in this final layer.

While this type of structure has worked well and has been widely used, it suffers from a number of flaws. These include

- the considerable expense and effort used to form the initial layer is largely wasted as it plays no part in the structural integrity of the completed cladding; moreover, the sheet separates the initial layer from the final supporting layer, and the two exist as separate entities with an unstable zone in between them, this unstable zone being unable to take shearing stress;
- the application of the waterproofing membrane is very time-consuming and expensive;
- the waterproofing membrane is easily damaged, for example by the insertion of steel reinforcing in the supporting layer;
- it is particularly difficult to form properly the roof of the tunnel with concrete of sufficient quality;
- it is difficult to achieve small radii with this method.

In addition, where tunnels are being bored by machines such as shield tunnel boring machines with long supply and cladding vehicles following them, especially those which are fitting prefabricated elements on the initial layer, it is very difficult and expensive to fit the waterproofing membrane.

It has now been discovered that these problems can be at least substantially overcome by the use of a novel structure and a novel way of applying this structure. The invention therefore provides a construction applied to a partially-overhanging substrate, the construction comprising (a) a sealing first layer applied directly to a surface of the partially-overhanging substrate; and (b) a non-deformable second layer applied to the first layer, characterised in that the sealing first layer is a plastics material and its surface is so configured as to provide anchoring means which anchor together the first layer and the applied second layer to form in effect a single layer capable of withstanding shearing stress.

The invention further provides a method for cladding a partially-overhanging substrate, comprising the steps of applying to a surface of the partially-overhanging substrate at least one sealing first layer, followed by the application of at least one non-deformable second layer, characterised in that anchoring means formed in the surface of the first layer anchor the first and second layers together to form in effect a single layer.

By "a surface of the partially-overhanging substrate" is meant either the substrate itself or an initial layer already applied to that substrate, as mentioned hereinabove in the discussion of the prior art. In this invention, the initial layer, when present, is preferably shotcrete.

The sealing first layer may be any suitable plastics or synthetic polymeric material known to the art which can be applied by spraying, one example being a thermosetting polyurethane.

An essential feature of the invention is the configuring of the surface of this first layer to provide anchoring means, so that it forms with the subsequently-applied non-deformable second layer what is in effect a single layer. This can be achieved by several methods. One possibility is to modify the surface by mechanical means before it has fully hardened. These modifications could take the form of irregularities such as webs and grooves formed in the layer, shapes to which the second layer will conform to anchor the two layers together. A further possibility is to include in the first layer, usually by embedding after layer formation, solid material which will cause suitable irregularities in the surface. A typical suitable material is a granulate, especially stone chips. A still further possibility may be used when, as hereinabove described, there is applied to the substrate an initial layer of concrete to which the sealing first layer is then applied. The surface of this initial layer may be provided with anchoring means. The sealing first layer applied thereto can then itself be provided with anchoring means. However, the first layer will preferably be so thin that it will also bear the profile of the initial layer on its external surface and the second layer will therefore conform to it. In such a case, this initial layer is preferably shotcrete. It is of course possible and permissible to use combinations of these methods.

The non-deformable second layer is preferably a sprayed concrete (shotcrete). Into this layer can be incorporated reinforcing, preferably by including suitable fibres in the material to be applied. It is preferred that such fibres be present.

The construction of the present invention has numerous advantages. Because the two layers behave as one entity, the sealing film more readily retains its integrity and therefore watertightness, and is less prone to mechanical damage and is capable of coping with shearing stress. This is also true when an initial layer is applied to the rock face—all three act as a single layer, and all contribute to the support of the rock. As a result, the thickness of construction needed can be considerably less than that of a conventional construction.

The invention is further described with reference to the following drawings.

Figure 2:
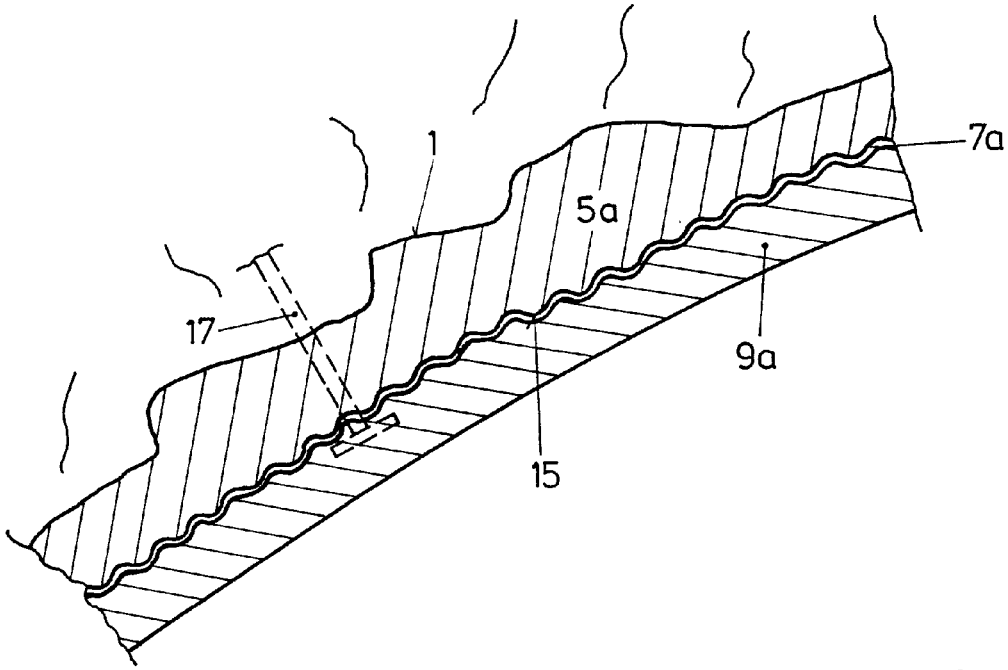
FIG. 2 is a partial transverse cross-section of a first embodiment of the invention.
Figure 2A:
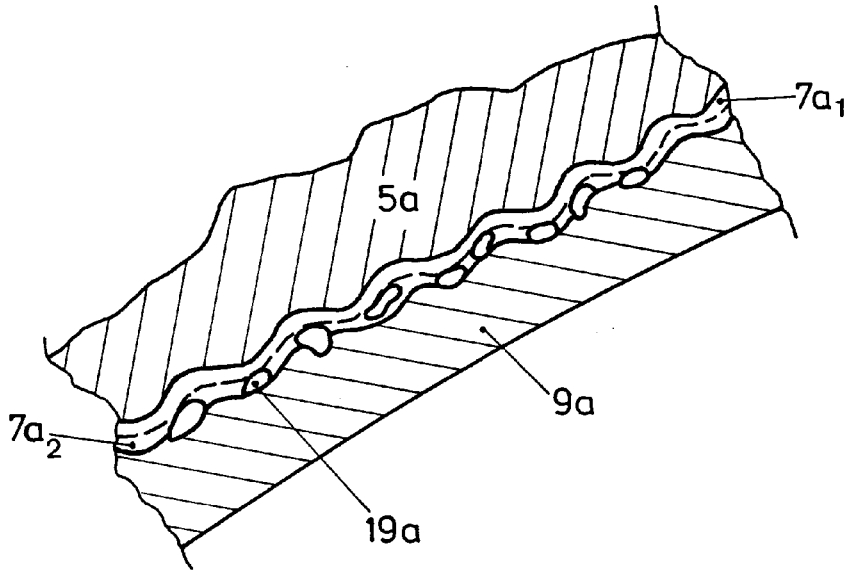

FIG. 2*a* is a partial transverse cross-section of a second embodiment of the invention.

Figure 3:
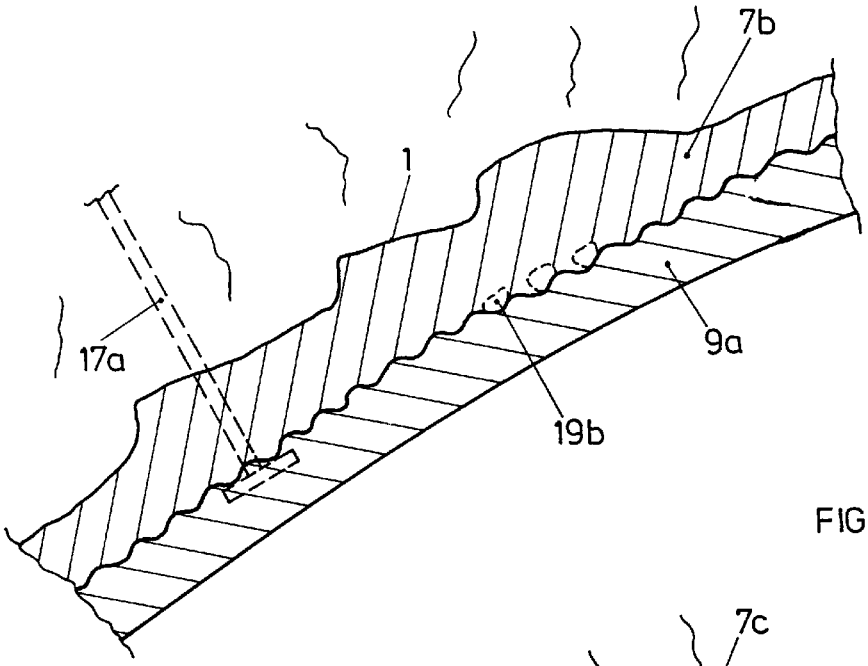

FIG. 3 is a partial transverse cross-section of a third embodiment of the invention.

Figure 4A:
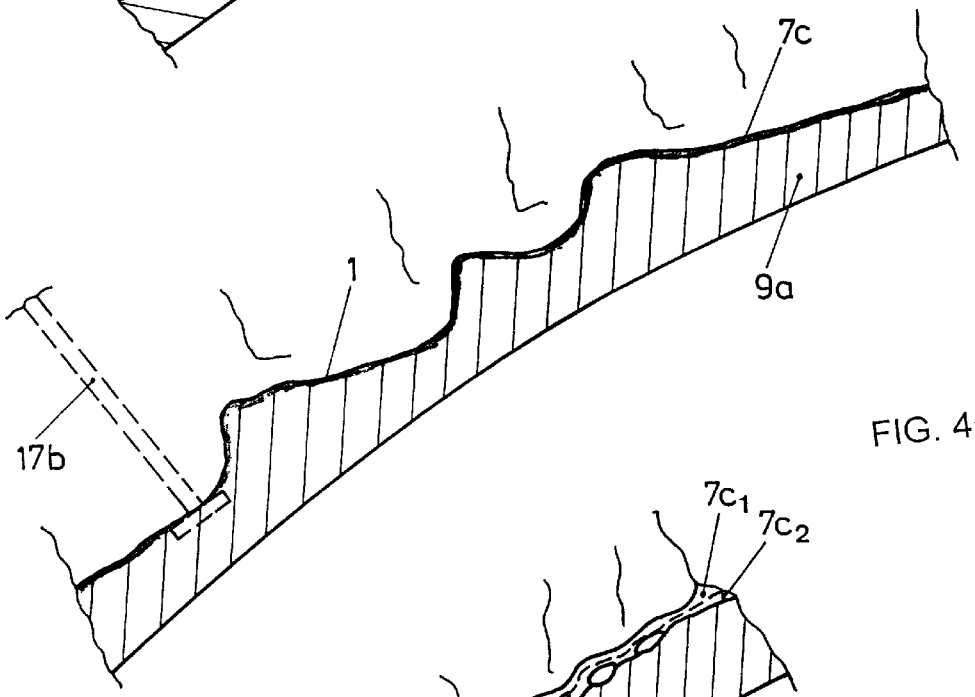

FIG. 4*a* is a partial transverse cross-section of a fourth embodiment of the invention.

Figure 4B:
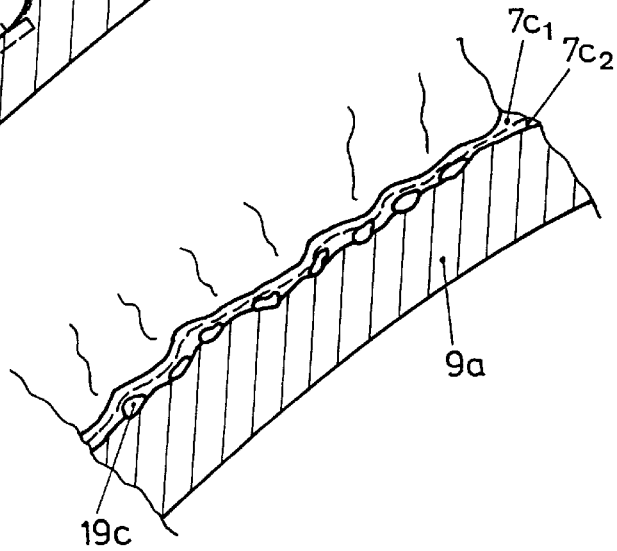

FIG. 4*b* is an enlarged cross-section of the embodiment of FIG. 4*a*.

Figure 1:
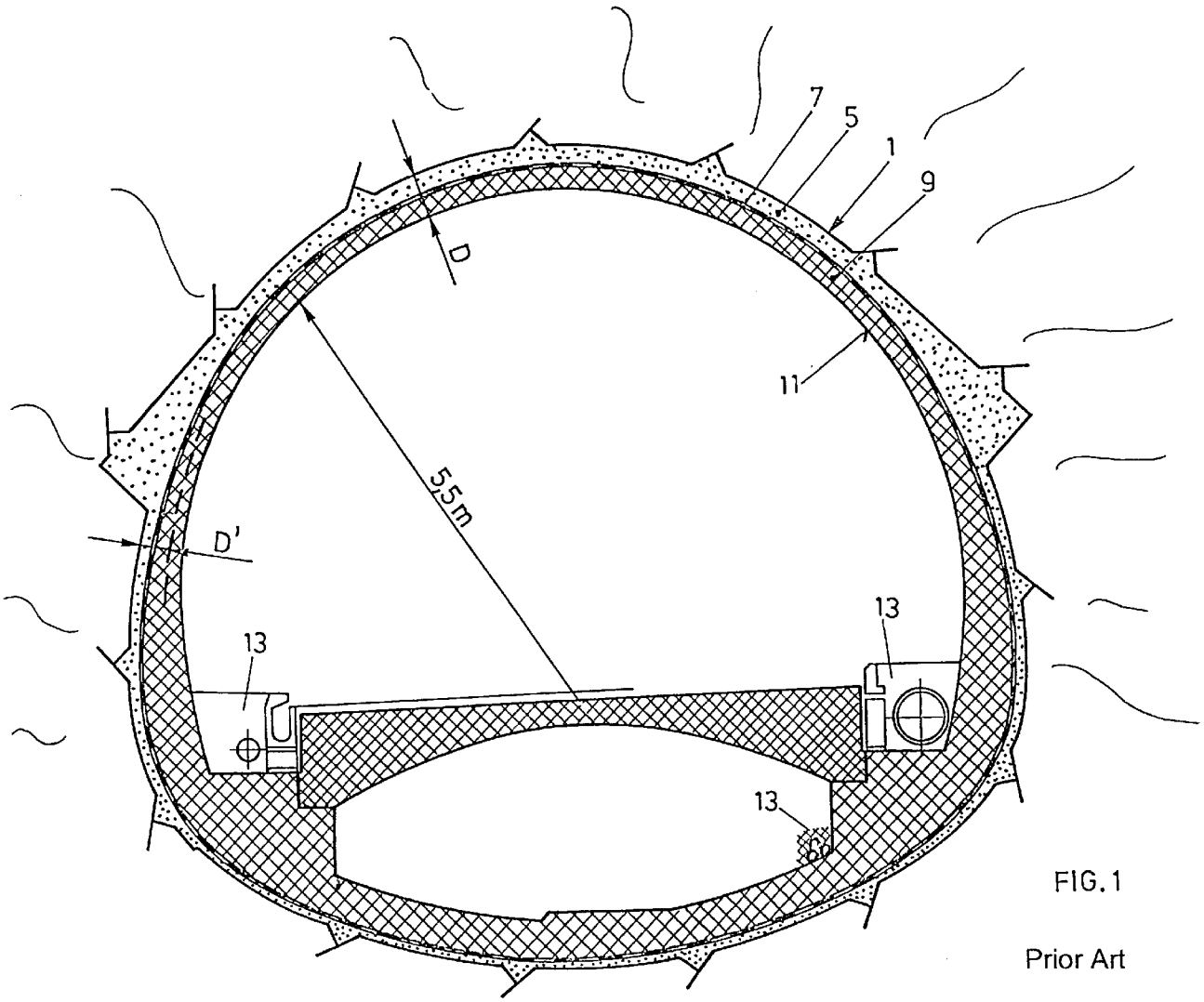
FIG. 1 Prior Art
FIG. 1 depicts a transverse cross-section of a tunnel which comprises a construction according to the prior art.

In the prior art tunnel of FIG. 1, an initial layer 5 is applied to a tunnel rock face 1. This may be done by shotcreting or lining with prefabricated sections and sealing with grout. To this initial layer is fixed by any convenient means a sheet of plastics material 7. To this is applied a supporting layer 9, generally made by pouring concrete into formwork. Reinforcing is included in this layer. Any technical installations 13 (such as piping and wiring) are incorporated near the inner tunnel surface 11.

In the embodiment of FIG. 2, an initial layer 5*a* of shotcrete is applied to a tunnel wall. Just prior to the termination of this operation, the surface of the initial layer is given a profile by mechanical action or by moving the spray nozzle in such a way as to produce surface irregularities. A sealing layer 7*a* of polyurethane resin is applied to the initial layer by spraying, the outer surface of this sealing layer nearly exactly corresponding to that of the surface 15 of the initial layer beneath. Finally, rock anchors 17 are driven into the rock to provide security and a layer of shotcrete 9*a* is applied.

FIG. 2*a* depicts an embodiment similar to that of FIG. 2, in enlarged cross-section. In this case, after a sealing layer $7a_1$ is sprayed, stone chips 19*a* are embedded therein, and the layer is then sprayed with a further sealing layer $7a_2$, prior to the application of a final non-deformable layer 9*a*.

FIG. 3 depicts an embodiment wherein a relatively thick sealing layer 7*b* is sprayed directly on to a rock surface. The surface of this layer is profiled by any suitable means before it hardens and rock anchors 17*a* are driven in to give extra security, prior to the application of the non-deformable layer 9*a*.

FIG. 4*a* depicts an embodiment which is similar in concept to that of FIG. 3, but wherein the thick sealing layer 7*b* of FIG. 3 is replaced by a relatively thin sheet of sealing layer 7*c*, this following closely the contours of the rock surface to which it is applied. In this case, the surface contours themselves supply the profiling which serves to anchor the two layers together. If necessary, rock anchors 17*b* can be applied, prior to the spraying of the non-deformable layer 9*a*.

FIG. 4*b* depicts a preferred embodiment of the embodiment of FIG. 4*a*, wherein the feature of the FIG. 2*a* embodiment, the addition of stone chips to the unhardened sealing layer, is utilised. In this case a first sealing layer $7c_1$ is applied and stone chips 19*c* are embedded therein, prior to the application of a second sealing layer $7c_2$. To this sealing layer is then applied a non-deformable layer 9*a*.

Reference is made again to FIG. 1, where the dotted line at the left of the drawing which is accompanied by the thickness indication D' is an indication of how much thinner a construction according to the present invention can be, in comparison with the conventional construction thickness D, as shown at the top of FIG. 1. In this particular instance, in a tunnel of approximately 5.5M radius, D' is thinner than D by approximately 20 cm. This represents a substantial savings in time and material.

What is claimed is:

1. A construction applied to a substrate, the construction comprising a) a sealing first layer applied directly to a surface of the substrate; and b) a non-deformable second layer applied to the first layer, characterized in that the sealing first layer is a plastics material and has a surface configured as to provide anchoring means which anchor together the said first layer and the said second layer.

2. A construction according to claim 1, characterized in that the surface of the substrate is an initial layer of concrete that includes surface anchoring means.

3. A construction according to claim 1, characterized in that the first layer includes formed irregularities which provide anchoring means for the second layer.

4. A construction according to claim 1, characterized in that the surface on which the first layer is applied has irregularities and the first layer is of such thickness that said irregularities are also borne by the surface of the first layer, thus providing anchoring means for the second layer.

5. A construction according to claim 1, characterized in that there is embedded in the first layer a granulate.

6. A construction according to claim 1, characterized in that the second layer is shotcrete.

7. A method for cladding a substrate, comprising the steps of:

applying to the substrate at least one sealing first layer the surface thereof which includes an anchoring means, subsequently applying at least one non-deformable second layer, which second layer is anchored to the first layer by the said anchoring means.

8. A method according to claim 7, characterized in that the sealing first layer is applied to the substrate as a thin layer which follows the profile of the substrate.

9. A method according to claim 7, characterized in that the anchoring means is created by forming irregularities in the first layer.

10. A method according to claim 7, characterized in that the anchoring means is created by embedding granulate in the first layer prior to the application of the second layer.

11. A method according to claim 7, characterized in that the sealing first layer is applied to the substrate at least partially obscuring the profile of the substrate.

12. A construction applied to a substrate, the construction comprising:

a) a sealing first layer formed of a plastics material applied directly to a surface of the substrate, said sealing first layer which includes an anchoring means, and b) a non-deformable second layer applied to the first layer, which is anchored to the sealing first layer by said anchoring means.

13. A construction according to claim 12 wherein the anchoring means are irregularities formed in the sealing first layer.

14. A construction according to claim 12 wherein the anchoring means are granulates at least partially embedded in the sealing first layer.

15. A construction according to claim 12 wherein the anchoring means is the sealing first layer which bears the profile of the substrate upon which the first layer is applied.

16. A construction according to claim 12, characterized in that the second layer is shotcrete.

* * * * *